US006386114B1

(12) United States Patent
Morgan et al.

(10) Patent No.: US 6,386,114 B1
(45) Date of Patent: May 14, 2002

(54) SINGLE SHAFT TAMPER WITH RECIPROCATING ROTATIONAL OUTPUT

(75) Inventors: John Morgan, Everton Park; Peter Youngman, Arana Hills, both of (AU)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 09/614,999

(22) Filed: Jul. 12, 2000

(51) Int. Cl.[7] ..... E01B 27/14

(52) U.S. Cl. ..... 104/13; 104/14; 104/10; 173/124; 173/122; 173/49

(58) Field of Search ..... 104/14, 10, 12, 104/13; 173/210, 122, 205, 124, 49, 132

(56) References Cited

U.S. PATENT DOCUMENTS 798,416 A * 8/1905 Jackson ..... 173/49
1,399,387 A * 12/1921 Jackson ..... 173/122
1,464,570 A * 8/1923 Hage ..... 173/124
1,621,103 A * 3/1927 Brumell ..... 173/122
1,932,723 A * 10/1933 Brown ..... 173/124
2,079,909 A * 5/1937 Jackson ..... 173/124
2,201,023 A * 5/1940 Brown ..... 173/205
3,856,426 A * 12/1974 Waschulewski et al. .... 404/133
4,014,620 A * 3/1977 Vural et al. ..... 404/133
4,069,763 A 1/1978 Theurer
4,240,352 A * 12/1980 Theurer ..... 104/12
5,031,542 A 7/1991 Theurer
5,343,810 A 9/1994 Theurer

* cited by examiner

*Primary Examiner*—S. Joseph Morano
*Assistant Examiner*—Frantz F. Jules
(74) *Attorney, Agent, or Firm*—David C. Jenkins; Eckert Seamans Cherin & Mellott, LLC

(57) ABSTRACT

A split tool tamper having a motor, a frame, a single tool shaft, and a tamping tool. The motor is coupled to the frame and the tool shaft is coupled to the motor. The tool shaft is further coupled to a single tamping tool.

3 Claims, 7 Drawing Sheets

SINGLE SHAFT TAMPER WITH RECIPROCATING ROTATIONAL OUTPUT

BACKGROUND THE INVENTION

1. Field of the Invention

This invention relates to a railroad track ballast tamping device and, more specifically, to a split tool tamper having a single tamping tool which may be operated independently of any adjacent tamping tools.

2. Description of the Prior Art

The ballast underlying a railroad track must be compressed during the installation of new track or repairing old track. The typical means for compressing the railroad track ballast is to vibrate and/or tamp the ballast using a tamping machine. A tamping machine typically consists of two pairs of tamping tools connected to a common vibrating device. The vibrating device causes the tamping tools to oscillate rapidly about the axis of an output shaft. Typically a pair of tamping tools are in a spaced relation to each other so that the tamping tools are located on either side of a rail. One pair of tamping tools is located on one side of a railroad tie and the other pair of tamping tools is located on the opposite side of the railroad tie. For example, a twin shaft vibrator may be provided with tool shafts which are approximately 504 mm apart. Typically, the tamping device is mounted on a railroad vehicle.

Because tamping devices are structured to have a pair of tamping tools which are positioned to be on either side of the railroad rail, the area between converging and/or diverging rails, such as at a railroad switch or crossing, cannot be accessed by the parallel tamping tools. To overcome this disadvantage, railroad tamping tools mounted on single side of a rail have been manufactured, see e.g., U.S. Pat. No. 5,343,810. This tamping device, however, still provides two tamping tools which are operated by a single vibrating device. This configuration has similar disadvantages to the prior art in that substantial portions of the ballast adjacent to the switch and/or crossing may remain untamped.

There is, therefore, a need for a tamping device which is capable of tamping substantially all of the railroad ballast including those portions of ballast disposed adjacent to switches and/or crossings.

There is a further need for a railroad tamping device having a tamping tool which is capable of acting independently of other tamping tools of the tamping device.

SUMMARY OF THE INVENTION

These needs and others are satisfied by the invention which provides for a split tool tamping device having a single tamping tool extending therefrom. The split tool tamping device may be mounted on a railroad vehicle adjacent to other tamping devices. The split tool tamping device, however, may be operated independently of any adjacent tamping device.

This invention includes a vibrating device, such as a motor having a rotating output shaft, a conversion device which converts the rotational motion of the hydraulic motor to an oscillating rotational motion, a tool shaft connected to the conversion device, and a tamping tool connected to the tool shaft. The motor may be mounted on a frame which is attached to a railroad vehicle.

It is an object of this invention to provide a split tool tamper which includes a motor coupled to a frame and a tool shaft coupled at one end to the motor and terminating in a single tamping tool.

It is a further object of this invention to provide a split tool tamper having a motor with a rotating output shaft and a conversion device that converts the rotational motion of the output shaft into a reciprocating rotational motion in a tool shaft.

It is a further object of this invention to provide a split tool tamper that may be coupled to conventional railroad vehicles.

It is a further object of this invention to provide a split tool tamper that does not interfere with the operation of any adjacent tamper.

BRIEF DESCRIPTION OF THE FIGURES

A full understanding of the invention can be gained from the following description of the preferred embodiments when read in conjunction with the accompanying drawings in which.

DESCRIPTION OF THE PREFERRED EMBODIMENTS

Figure 1:
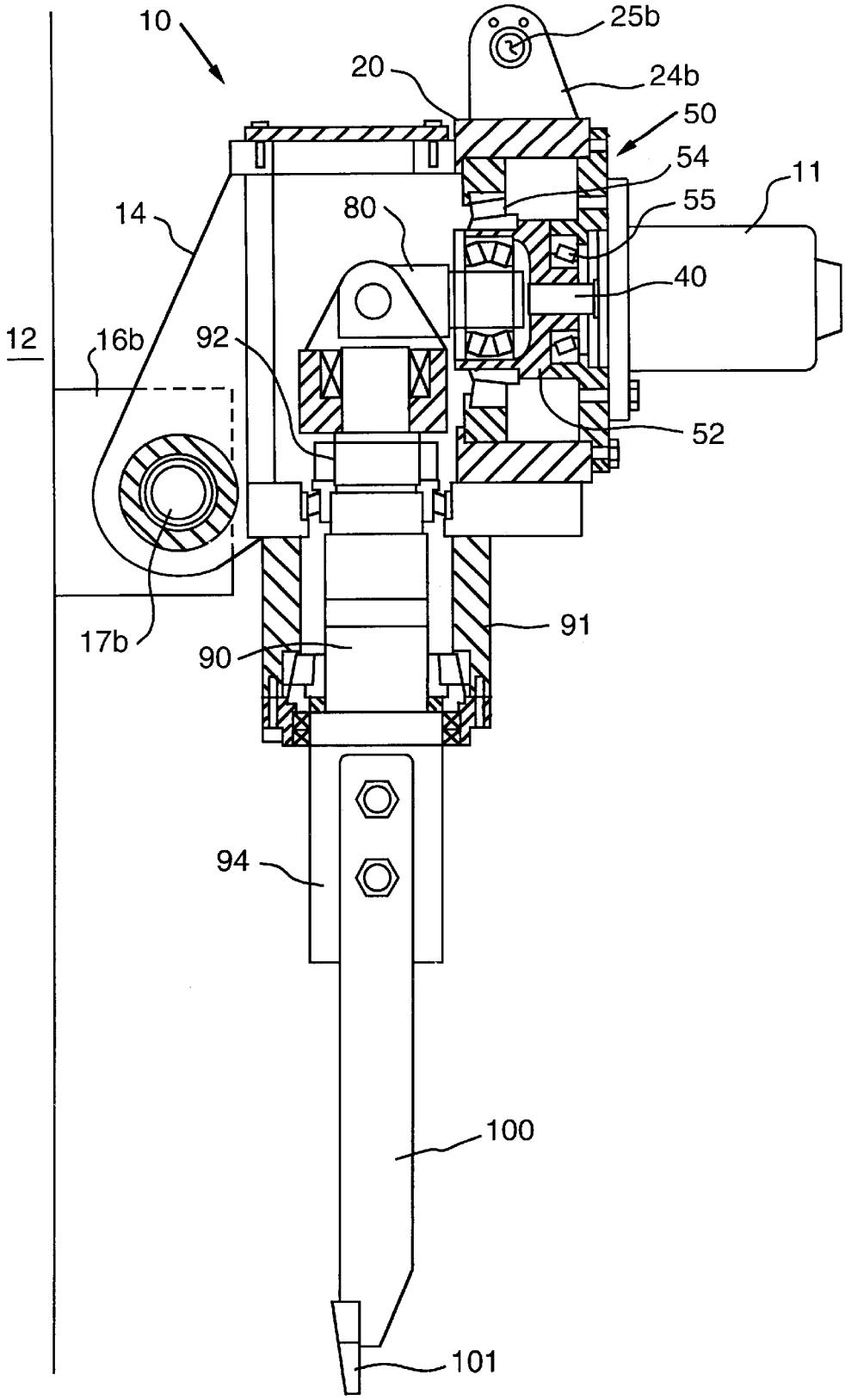
FIG. 1 shows a partial cross-sectional side elevation view of a split tool tamper according to the present invention.
Figure 4:
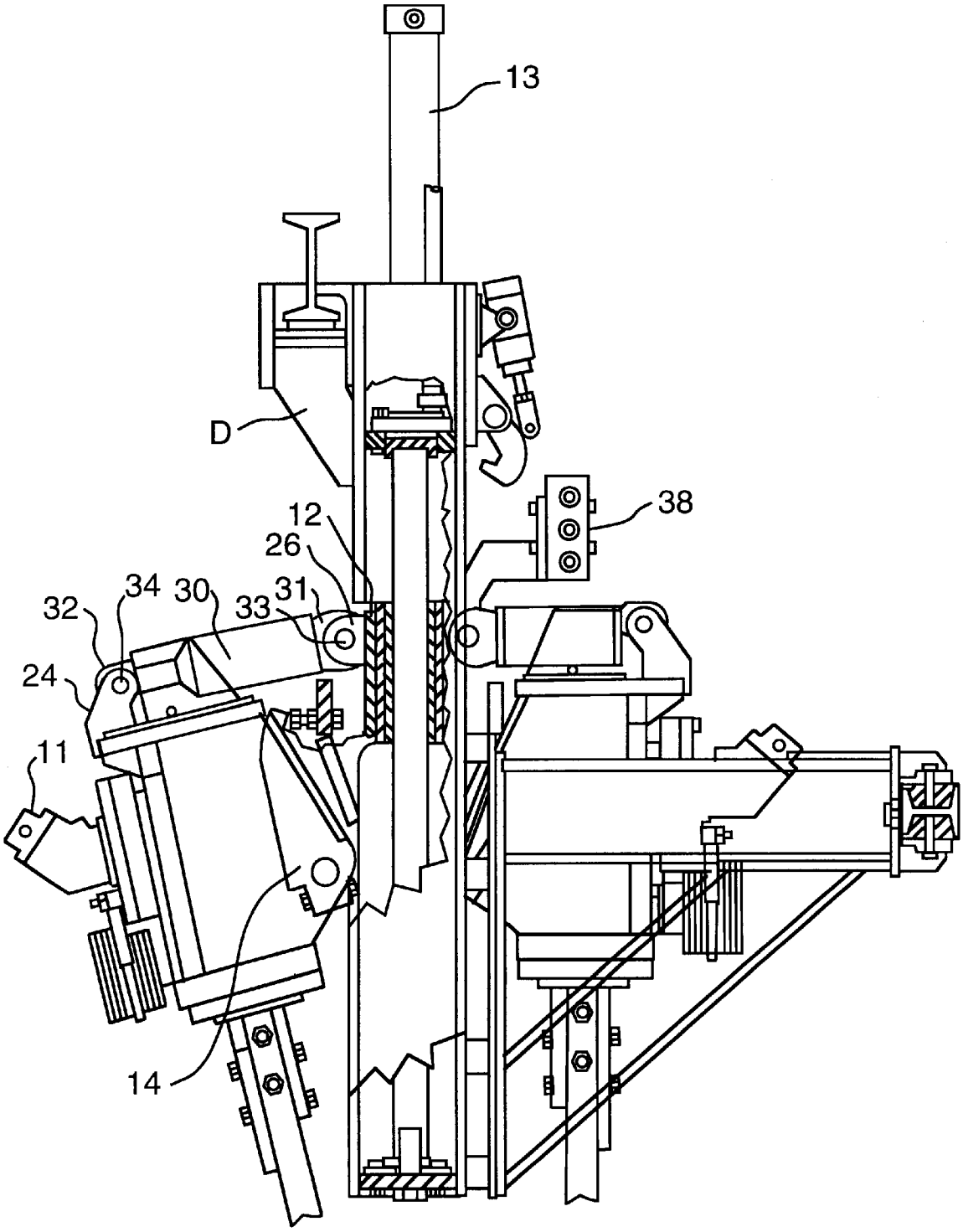
FIG. 4 is a side view showing the split tool tamper attached to a frame.

As shown in FIG. 1, the split tool tamper 10 of the present invention includes a motor 11, such as a hydraulic motor, a conversion device 50, and a single tool shaft 90. The split tool tamper 10 may be pivotally attached to a generally vertical frame 12. The frame 12 may be attached to vertical translation means, such as a hydraulic piston 13 (FIG. 4). The vertical translation means may be coupled to a railroad car (not shown) or other suitable vehicle which may travel over a railroad ballast bed. The conversion device 50 is enclosed with in a housing 20. The split tool tamper 10 further includes a tool shaft 90 and a tamping tool 100. The tool shaft 90 is enclosed within output shaft housing 91.

Figure 2:
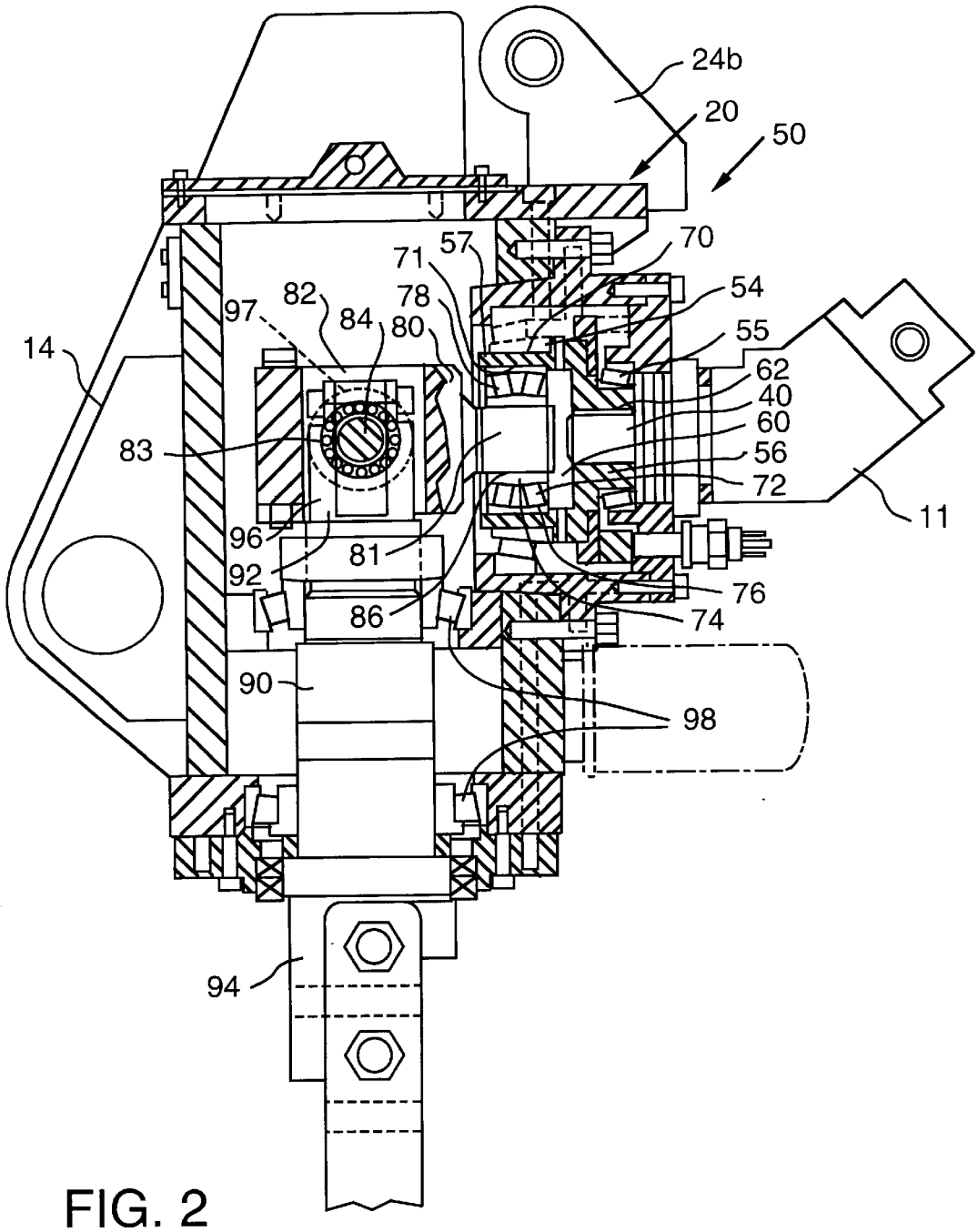
FIG. 2 is a partial cross-sectional view detail of the upper portion of the split tool tamper.
Figure 3:
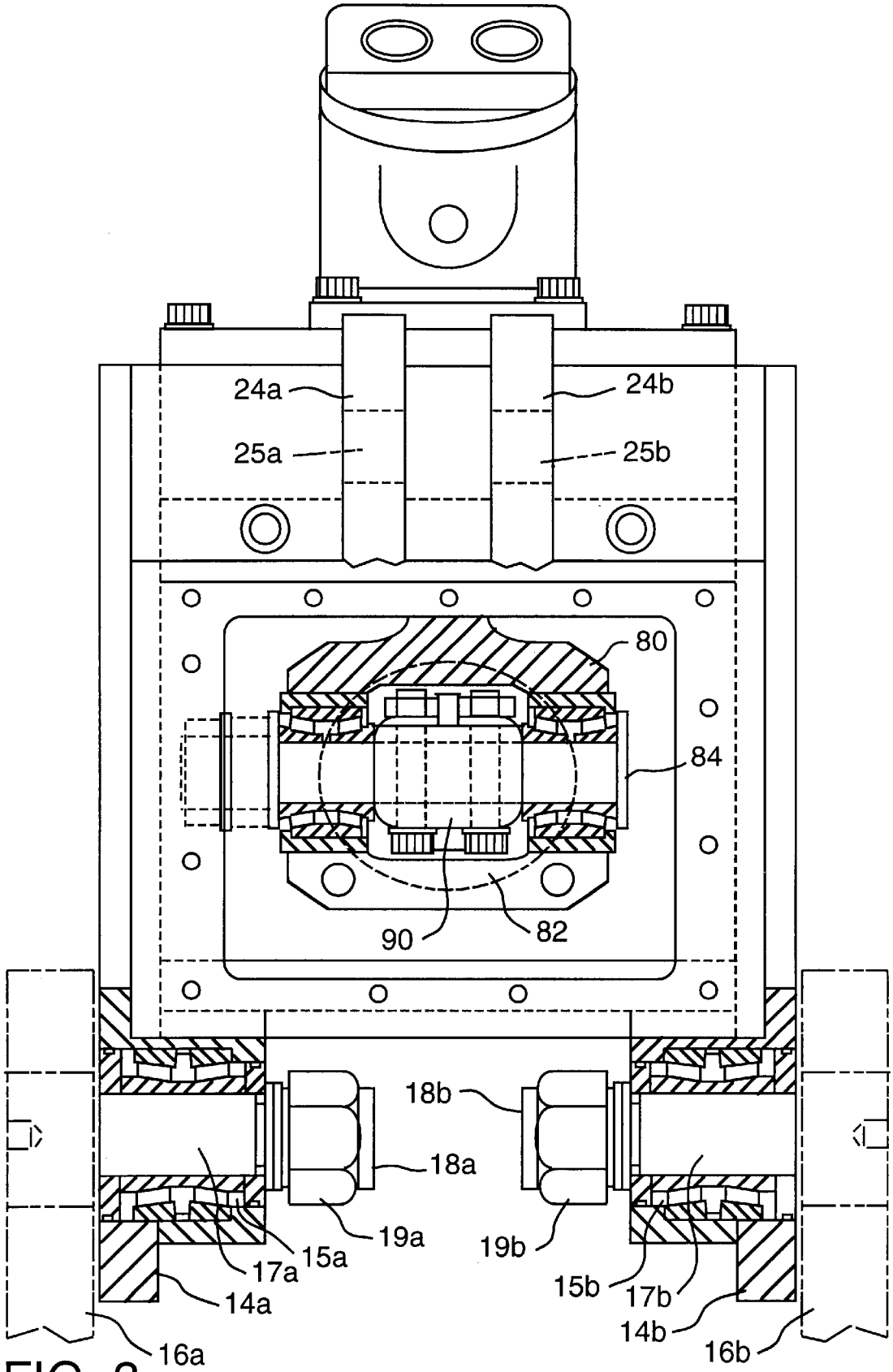
FIG. 3 is a partial cross-sectional top view of the split tool tamper.

The housing 20 may include a lower mounting protrusion 14 and an upper mounting protrusion 24. As shown in FIGS. 2–4, lower mounting protrusion 14 may be a pair of tabs 14*a*, 14*b* (FIG. 3). Each tab 14*a*, 14*b* includes an opening 15*a*, 15*b* therethrough. Frame 12 includes a pair of mounting tabs 16*a*, 16*b* which are sized and spaced to correspond to housing tabs 14*a*, 14*b*. Each frame tab includes an opening therethrough. A pin 17*a*, 17*b* having a threaded end 18*a*, 18*b* passes through each frame tab 16*a*, 16*b*, and housing tab 14*a*, 14*b*. A nut 19*a*, 19*b* engages threaded ends 18*a*, 18*b* thereby pivotally mounting housing 20 to frame 12.

The housing 20 is further connected to frame 12 at upper mounting protrusion 24. Upper mounting protrusion 24 may have tabs 24*a*, 24*b* each having an opening 25*a*, 25*b* therethrough. Frame 12 includes an upper frame tab 26 proximal to the upper mounting protrusion 24. The upper frame tab 26 includes an opening therethrough. An extension member 30, such as a hydraulic cylinder, extends between frame 12 and upper mounting protrusion 24. The extension member 30 includes a first coupling end 31 and second coupling end 32. The coupling ends 31, 32 may have an opening for a pin. The extension member 30 may be coupled to frame 12 by mounting pins 33, 34. As shown, mounting pin 33 is disposed through the opening in the first coupling end 31 and tab 26. The other mounting pin 34 is disposed in the second coupling end 32 and openings 25*a*, 25*b*. The extension member 30 has a first, closed position and a second, maximum extended position. Preferably, the split tool tamper may be angled 0 to 13 degrees from vertical by extending the extension member 30. In the first, closed position, extension member is structured to align tool shaft 90 substantially parallel to frame 12. In the second, extended position, extension member 30 causes housing 20 to rotate clockwise, as shown in FIG. 1, about mounting pins 17*a*, 17*b* so that tool shaft 90 is angled downwardly and inwardly relative to frame 12. The extension member may be coupled to a hydraulic system 38 which can cause extension member 30 to move between the first and second position approximately every three seconds.

Motor 11 includes a rotating output axle 40 having a generally horizontal axis when extension member 30 is in the first position. Rotating output axle 40 is connected to conversion device 50. As is well know in the prior art, motor 11 rotates output axle 40 around the generally horizontal axis. Preferably, the motor 11 will rotate output axle 40 at about 3000 R.P.M. As described below, the motor 11 in conjunction with conversion device 50 creates a reciprocating rotational motion in tool shaft 90.

As shown in FIGS. 1 and 2, conversion device 50 includes an eccentric hub 52 having a generally horizontal axis and an eccentric hub mounting means, such as a first roller bearing 54 and a second roller bearing 55. The eccentric hub mounting means 54 extends between housing 20 and outer bearing surface 70 (described below). The eccentric hub 52 is generally cup-shaped having a disk 56 with a sidewall 57 extending from the perimeter of the disk 56. The sidewall 57 forms a recess 60 having an open face. Disk 56 is generally circular and includes a medial opening 62 therethrough. Sidewall 57 includes a thick portion 64 and a thin portion 66. Thick portion 64 is located on the opposite side of disk 56 from thin portion 66. Sidewall 57 gradually decreases in thickness from thick portion 64 to thin portion 66. The sidewall outer surface is an outer bearing surface 70. The sidewall 57 also includes an inner wall which forms an inner bearing surface 71.

The conversion device 50 further includes a spherical roller bearing 72. Spherical roller bearing 72 is a toroid having a medial opening 74 and an outer bearing surface 76. Roller bearing 72 is disposed within the eccentric hub recess 60. Roller bearing outer surface 76 contacts sidewall inner bearing surface 71. Spherical roller bearing 72 also includes an inner bearing surface 78.

The conversion device 50 further includes a yoke 80 having a shaft 81, a vertical cavity 82 and a horizontal pin opening 83. Shaft 81 includes an outer bearing surface 86. Shaft 81 is disposed within roller bearing medial hole 74 with bearing surface 86 contacting roller bearing inner bearing surface 78. An attachment pin 84 is disposed in horizontal pin opening 83.

Tool shaft 90 includes an upper end 92 and a lower end 94. Upper end 92 forms a mounting bracket 96 having an opening 97 therethrough. Tool shaft opening 97 is sized to engage attachment pin 84. Shaft lower end 94 includes a tamping tool 100. The tamping tool 100 has a lower end 101 that is structured to contact railroad ballast. Tool shaft 90 is supported in housing 20 by two spaced bearings 98. Tool shaft 90 is supported by bearings 98 so that tool shaft 90 extends generally perpendicular to rotating axle 40.

As noted above, the split tool tamper 10 is pivotably mounted on a frame 12 by mounting pins 17*a* and 17*b*. The frame 12 is coupled by a hydraulic piston to railroad vehicle (not shown) so that the axis of mounting pins 17*a* and 17*b* extend generally in a direction perpendicular to the direction of the railroad rail. When extension member 30 is in the closed position, the axis of rotating axle 40 extends in a direction generally normal to the axis of mounting pins 17*a* and 17*b*. The axis of eccentric hub 52, which is attached to rotating axle 40, and roller bearing 72, which is disposed inside eccentric hub 52, also extend in a direction generally normal to the axis of mounting pins 17*a* and 17*b*. The shaft 81 is disposed within roller bearing 72, extending in a direction generally normal to the axis of mounting pins 17*a* and 17*b*. The yoke 80 may be positioned so that the axis of attachment pin 84 extends in a direction generally parallel to the axis of mounting pins 17*a* and 17*b*. Mounting bracket 96 is coupled to the conversion device 50 by passing attachment pin 84 through horizontal pin opening 83. When so configured, and when extension member 30 is in the first position, tool shaft 90 extends in a generally vertical direction. The angle of tool shaft 90 may be changed by extending extension member 30 to any point up to, and including, the maximum extended position of extension member 30. As noted above, the split tool tamper 10, preferably, may be angled 0 to 13 degrees from vertical.

In operation, motor 11 provides a rotational force to rotating axle 40. Rotating axle 40 rotates eccentric hub 52. Due to the eccentric shape of eccentric hub 52, the axis of eccentric hub 52 is reciprocated horizontally and vertically as axle 40 is rotated. Roller bearing 72, which is disposed within eccentric hub 52, is thereby reciprocated horizontally and vertically. The reciprocal motion of eccentric hub 52 is transferred from the roller bearing 72 to the shaft 81, yoke 80 and attachment pin 84, into tool shaft 90. The vertical position of tool shaft 90 is maintained by bearings 98. Thus, yoke 80 will pivot reciprocate in a vertical direction about pin 84. The horizontal reciprocation, however, is transferred to tool shaft 90 as described below.

Figure 5:
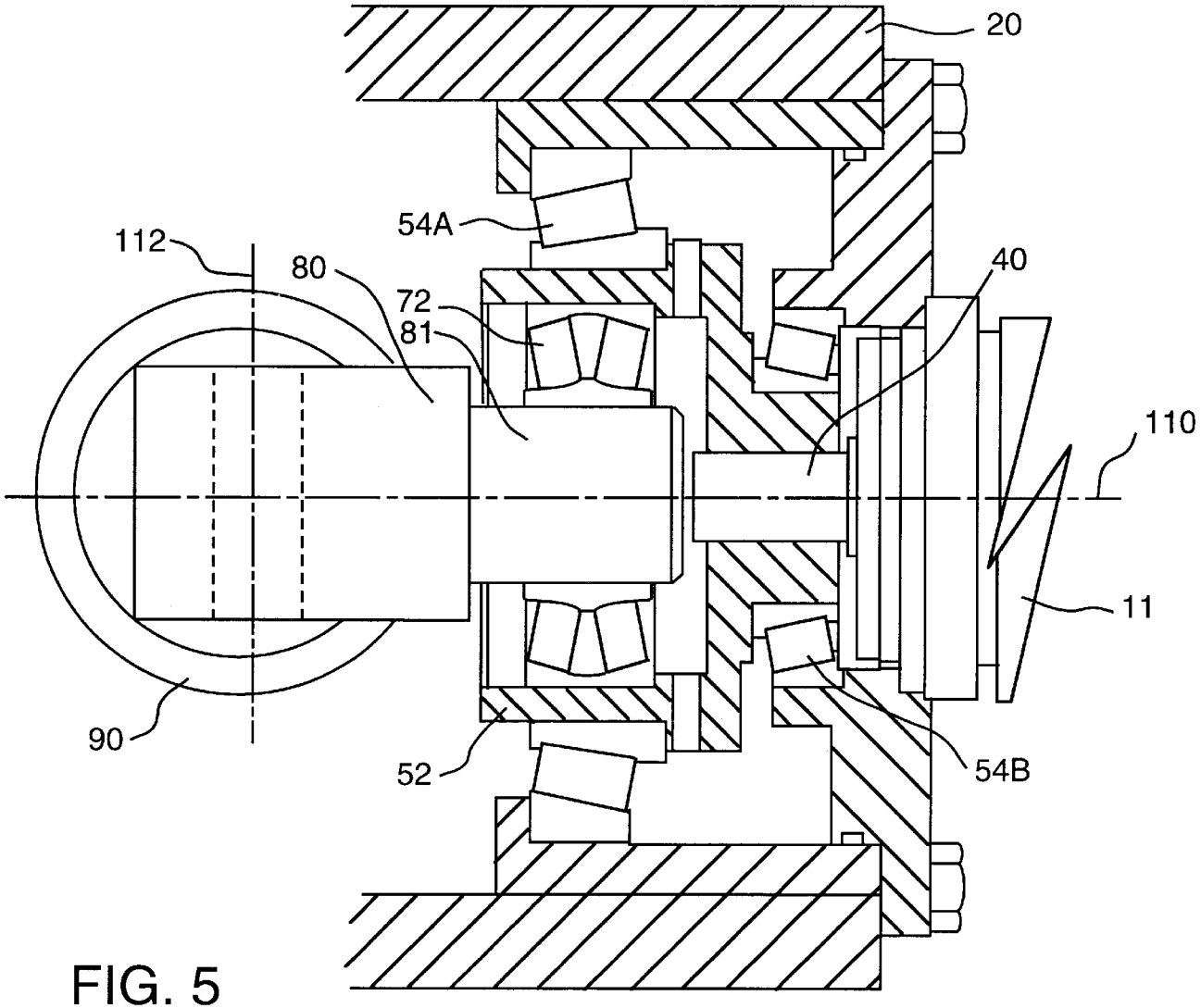
FIG. 5 is a schematic top view of the split tool tamper with the eccentric hub in the twelve o'clock position.
Figure 6:
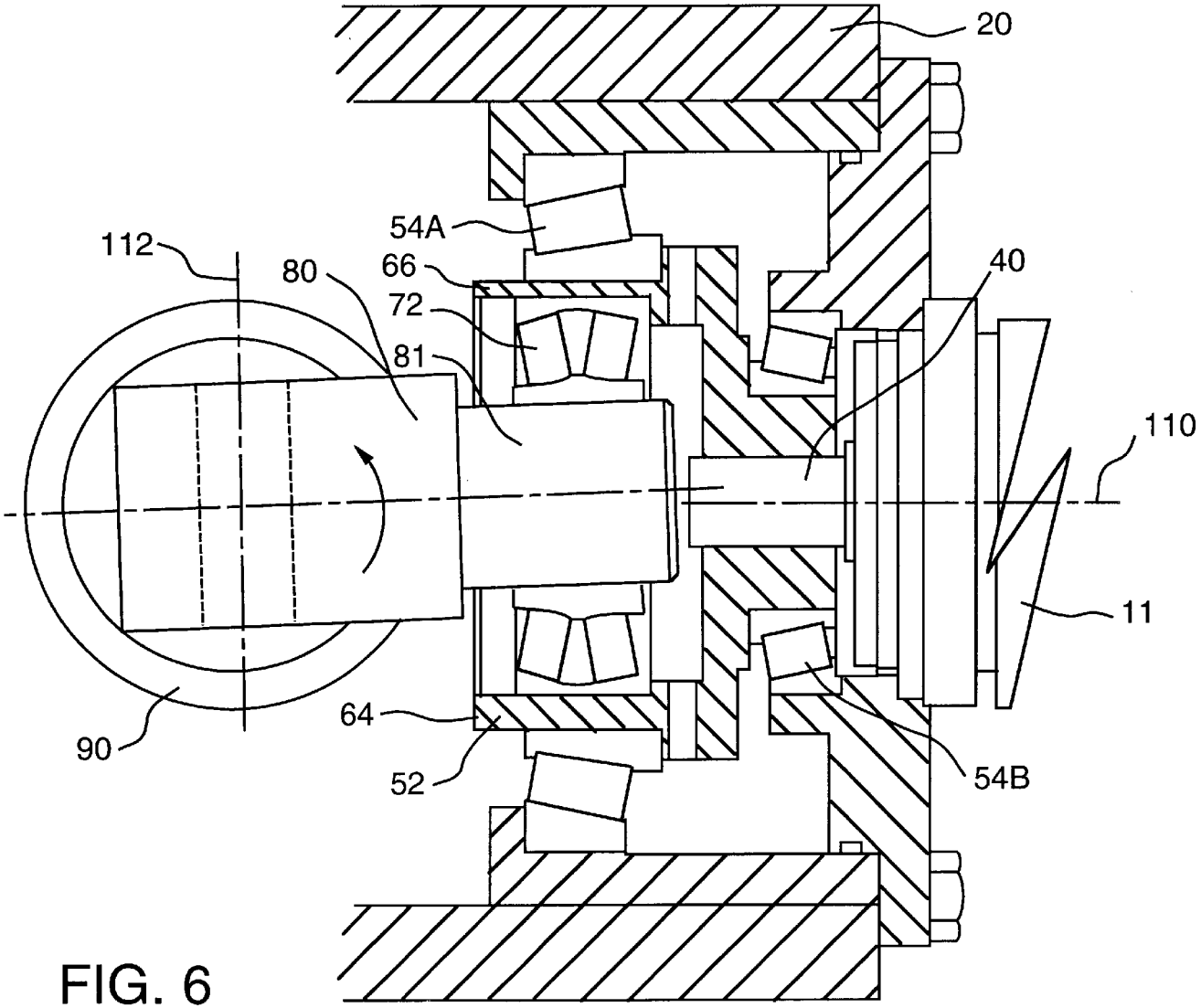
FIG. 6 is a schematic top view of the split tool tamper with the eccentric hub in the three o'clock position.
Figure 7:
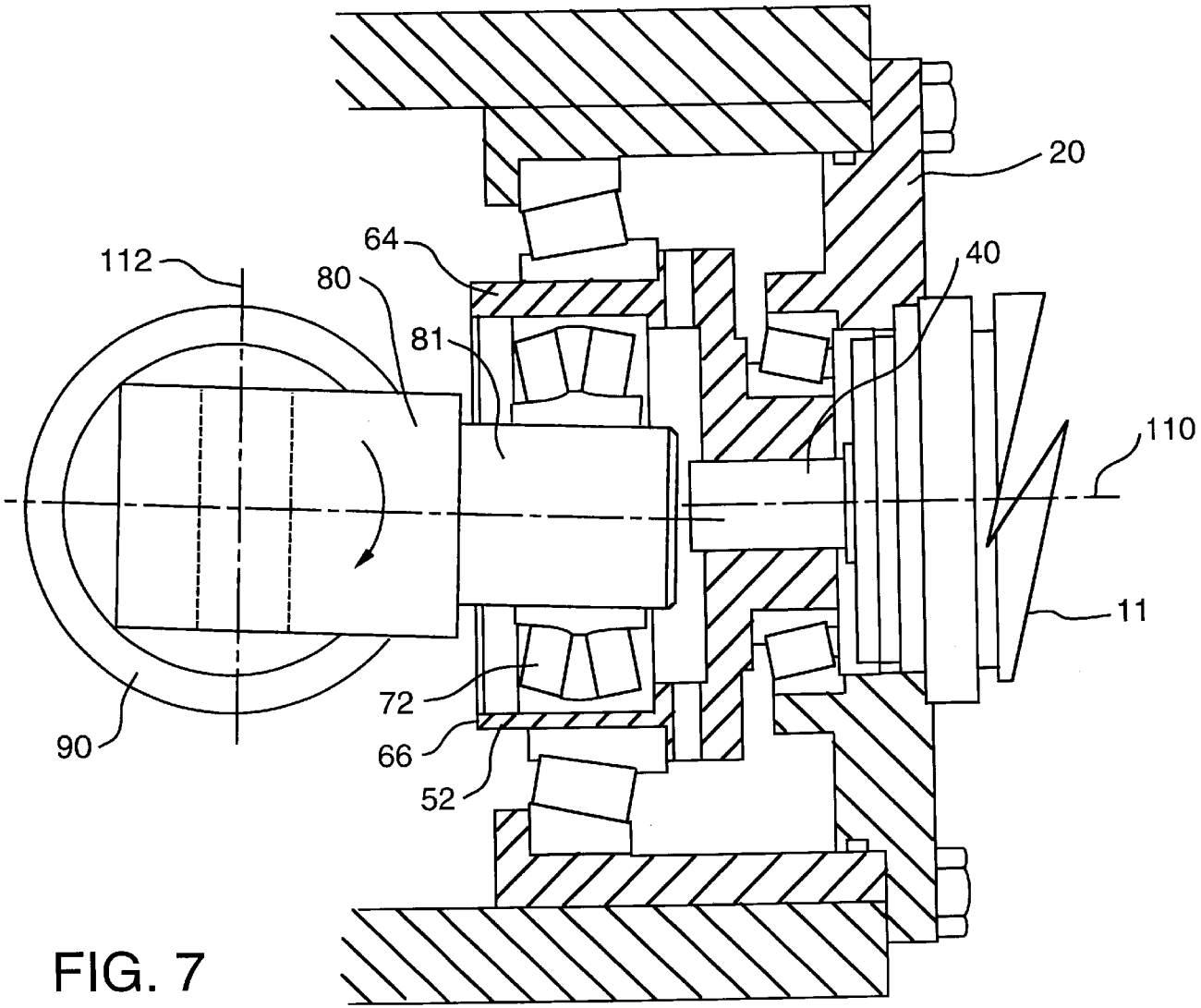
FIG. 7 is a schematic top view of the split tool tamper with the eccentric hub in the nine o'clock position.

For the sake of this discussion the location of the eccentric hub sidewall thick portion 64 will correlate to a clock's hour hand. Thus, when the eccentric hub 52 is described as being in the twelve o'clock position, sidewall thick portion 64 is in the upper most position. As shown in FIG. 5, the eccentric hub 52 is in the twelve o'clock position. When the eccentric hub 52 is in this position, the axis of shaft 81 and the axis of axle 40, when seen from above, are aligned. As shown in FIG. 6, when the eccentric hub 52 is in the three o'clock position, the axis of shaft 81, when seen from above, is offset approximately 2.5 degrees in a counter-clockwise direction from the axis of axle 40, as measured from the axis of shaft 90. When the eccentric hub is in the 6:00 o'clock position (not shown) the axis of shaft 81 and the axis of axle 40, when seen from above, are aligned. As shown in FIG. 7, when the eccentric hub 52 is in the nine o'clock position, the axis of shaft 81, when seen from above, is offset approximately 2.5 degrees in a clockwise direction from the axis of axle 40, as measured from the axis of shaft 90. Thus, rotation of eccentric hub 52 results in a reciprocal rotational motion in tool shaft 90.

While specific embodiments of the invention have been described in detail, it will be appreciated by those skilled in the art that various modifications and alternatives to those details could be developed in light of the overall teachings of the disclosure. For example, the motor may be a hydraulic, pneumatic or other type of motor. Accordingly, the particular arrangements disclosed are meant to be illustrative only and not limiting as to the scope of invention which is to be given the full breadth of the claims appended and any and all equivalents thereof. As used in the appended claims, "coupled," means a linkage, direct or indirect, so long as a linkage occurs.

What is claimed is:

1. A split tool tamper comprising:

a motor;

a frame;, said motor coupled to said frame;

a single tool shaft having a first end and a second end;

a said first end coupled to said motor;

a tamping tool;

said tamping tool coupled to said second end;

said motor is pivotably coupled to said frame by a generally horizontal pivot;

said motor is further coupled to said frame by an extension member attached to said motor at a location spaced apart from said pivot;

said motor provides a generally reciprocating rotational motion to said tool shaft;

said motor is coupled to said tool shaft by a conversion device;

said motor includes a housing and a rotating shaft;

said conversion device includes:

an eccentric hub having a medial opening and a circular sidewall;

said hub sidewall having an eccentric recess said axle passing through said medial opening and coupled to said hub;

a yoke having a shaft and a pivot pin;

said yoke shaft disposed in said hub eccentric recess;

a clevis disposed at said tool shaft first end;

said clevis coupled to said yoke pivot pin; and said tool shaft is supported by at least two bearings in said housing.

2. The split tool tamper device of claim 1, wherein said conversion device also includes:

a spherical roller bearing having a bearing surface and a medial opening;

said spherical roller disposed in said hub eccentric recess; and said yoke shaft disposed in said spherical roller medial opening.

3. The split tool tamper device of claim 2, wherein said motor is further coupled to said frame by an extension member attached to said motor at a location spaced apart from said pivot.

* * * * *

UNITED STATES PATENT AND TRADEMARK OFFICE

CERTIFICATE OF CORRECTION

PATENT NO. : 6,386,114 B1
DATED : May 14, 2002
INVENTOR(S) : John Morgan et al.

It is certified that error appears in the above-identified patent and that said Letters Patent is hereby corrected as shown below:

Column 5,
Line 13, remove "," after "frame".
Line 16, remove "a" before "said".
Line 17, after "motor", insert -- having an axle --.

Signed and Sealed this

Twenty-ninth Day of October, 2002

*Attest:*

*Attesting Officer*

JAMES E. ROGAN
*Director of the United States Patent and Trademark Office*